US006048130A

United States Patent [19]

Allen et al.

[11] Patent Number: 6,048,130

[45] Date of Patent: Apr. 11, 2000

[54] HYDRAULICALLY DRIVEN, MULTIPLE ROTOR RIDING TROWEL

[75] Inventors: J. Dewayne Allen, Paragould, Ark.; Michael W. McKean, Arlington, Tenn.; Timmy D. Guinn, Paragould; Hugh L. Adams, Bassett, both of Ark.

[73] Assignee: Allen Engineering Corporation, Paragould, Ark.

[21] Appl. No.: 09/199,009

[22] Filed: Nov. 23, 1998

Related U.S. Application Data

[63] Continuation-in-part of application No. 08/784,244, Jan. 15, 1997, Pat. No. 5,890,833.

[51] Int. Cl.[7] ..... E01C 19/22

[52] U.S. Cl. ..... 404/112

[58] Field of Search ..... 404/112

[56] References Cited

U.S. PATENT DOCUMENTS

| | | | |
|---|---|---|---|
| 2,898,826 | 8/1959 | Livermont | 404/112 |
| 3,936,212 | 2/1976 | Holz, Sr. et al. | 404/112 |
| 4,046,484 | 9/1977 | Holz, Sr. et al. | 404/112 |
| 4,784,519 | 11/1988 | Artzberger | 404/112 |
| 5,108,220 | 4/1992 | Allen et al. | 404/112 |
| 5,480,258 | 1/1996 | Allen | 404/112 |
| 5,584,598 | 12/1996 | Watanabe | 404/112 |
| 5,613,801 | 3/1997 | Allen | 404/112 |
| 5,685,667 | 11/1997 | Allen | 404/112 |

*Primary Examiner*—Robert E. Pezzuto
*Assistant Examiner*—Raymond W Addie
*Attorney, Agent, or Firm*—Stephen D. Carver

[57] ABSTRACT

A high performance, hydraulically-propelled, multiple rotor riding trowel for finishing concrete is controlled with hydraulic circuitry enabling steering wheel and foot pedal control. The rigid trowel frame preferably mounts three separate spaced-apart, downwardly-projecting, bladed rotor assemblies that frictionally engage the concrete surface. The rear rotor assemblies are tilted with double acting, hydraulic cylinders to effectuate steering and control in response to foot pedals. Double acting hydraulic cylinders also control blade pitch. Separate gimbaled, hydraulic motors revolve each rotor assembly. A steering wheel controlling a front, hydraulic steering control valve controls the front tilting cylinder to facilitates steering with minimal physical exertion.

2 Claims, 9 Drawing Sheets

HYDRAULICALLY DRIVEN, MULTIPLE ROTOR RIDING TROWEL

CROSS-REFERENCE TO RELATED APPLICATION

This application is a continuation in part of prior U.S. application, Ser. No. 08/784,244, Filed Jan. 15, 1997, and entitled Hydraulically Controlled Riding Trowel now U.S. Pat. No. 5,890,833, issued Apr. 6, 1999.

BACKGROUND OF THE INVENTION

1. Field of the Invention

This invention relates generally to motorized riding trowels for finishing concrete surfaces of the type classified in United States Patent Class 404, Subclass 112. More particularly, our invention relates to multiple-rotor, hydraulically driven and hydraulically controlled riding trowels.

2. Description of the Prior Art

It is well established in the concrete finishing art that freshly placed concrete must be appropriately finished to achieve the desired smoothness and flatness. As freshly poured concrete sets, it soon becomes hard enough to support the weight of motorized riding trowels, that are particularly effective for finishing concrete. Motorized riding trowels are ideal for finishing large areas of plastic concrete quickly and efficiently, and a variety of riding trowels are known in the art.

Typical riding trowels employ multiple, downwardly projecting rotors that contact the concrete surface and support the weight of the trowel. A typical rotor comprises a plurality of radially spaced-apart finishing blades that revolve in frictional contact with the concrete surface. The blades may be coupled to circular finishing pans for treating unhardened, "green" concrete. When the rotors are tilted, steering and propulsion forces are frictionally developed by the blades (or pans) against the concrete surface. Riding trowels finish large surface areas of wet concrete more efficiently than older "walk behind" trowels. Significant savings are experienced by the contractor using such equipment, as time constraints and labor expenses are reduced.

Preferably, the finishing process starts with panning while the concrete is still green, within one to several hours after pouring depending upon the concrete mixture involved. The advent of more stringent concrete surface finish specifications using "F" numbers to specify flatness (ff) and levelness (fl), dictates the use of pans on a widespread basis. Both "super-flat" and "super-smooth" floors can be achieved by panning with motorized trowels.

Pan finishing is normally followed by medium speed blade finishing, after the pans are removed from the rotors. A developing technique is the use of "combo blades" during the intermediate "fuzz stage" as the concrete continues to harden. So-called "combo-blades" are a compromise between pans and normal finishing blades. They present more surface area to the concrete than normal finishing blades, and attack at a less acute angle. The rotors are preferably turned between 100 to 135 RPM at this time. Finishing blades are then used, and they are rotated between 120 to 150 RPM. Finally, the pitch of the blades is changed to a relatively high contact angle, and burnishing begins. Rotor speeds of between 135 and 165 RPM are recommended in the final trowel finishing stage.

Holz, in U.S. Pat. No. 4,046,484 shows a pioneer, twin rotor, selfpropelled riding trowel wherein the rotors are tilted to generate steering forces. U.S. Pat. No. 3,936,212, also issued to Holz, shows a three rotor riding trowel powered by a single motor. Although the designs depicted in the latter two Holz patents were pioneers in the riding trowel arts, the devices were difficult to steer and control.

Prior U.S. Pat. No. 5,108,220 owned by Allen Engineering Corporation, the same assignee as in this case, relates to an improved, fast steering system for riding trowels. Its steering system enhances riding trowel maneuverability and control. The latter fast steering riding trowel is also the subject of U.S. Des. Pat. No. 323,510 owned by Allen Engineering Corporation.

U.S. Pat. No. 5,613,801, issued Mar. 25, 1997 to Allen Engineering Corporation discloses a power-riding trowel equipped with separate motors for each rotor. Steering is accomplished with structure similar to that depicted in U.S. Pat. No. 5,108,220 previously discussed.

Allen Engineering Corporation Pat. No. 5,480,258 discloses a multiple engine riding trowel. The twin rotor design depicted therein associates a separate engine with each rotor. As the engines are disposed directly over each revolving rotor assembly, horsepower is more efficiently transferred to the revolving blades. Besides resulting in a faster and more efficient trowel, the design is easier to steer. Again, manually activated steering linkages are used.

Allen Engineering Corporation Pat. No. No. 5,685,667 discloses a twin engine riding trowel using "contra rotation." Many trowel users prefer the steering characteristics that result when the trowel rotors are forced to rotate in a direction opposite from that normally expected in the art.

While modern, high power riding trowels are noted for their speed and efficiency, extreme demands are placed upon the relatively small, internal combustion motors that power such machines. Adequate horsepower must be available at all times for the rotors, that must operate under varying conditions of speed, drag, rotor tilt-angle, blade pitch, and concrete hardness. Demands upon drive motors can vary widely when switching between panning and blade-finishing modes. Generally speaking, the more powerful the trowel, the faster finishing operations can be completed. However, optimum engine speed (i.e., for rated torque and horsepower) is limited to a relatively small RPM range. On the other hand, a variety of blade speeds are required for modern finishing, and as explained earlier, load conditions vary widely as well.

Engine RPM is usually the essential variable related to output power. Typical riding trowel engines are coupled through belts and pulleys to gear boxes connected to the rotor shafts. The output shaft speed (i.e., rotor speed) is geared down, with a ratio of 20:1 being common. While it is recognized that effective motor output characteristics are RPM related, the use of fixed ratio reduction gearing often results in a mismatch between the desired blade speed, the frictional load, and the available motor horsepower at a given RPM.

If engine speed increases too much, excessive power may be developed, and the finishing mechanism may rotate too fast. For example, the initial panning stage requires relatively high power because of the viscous character of green concrete, but relatively low rotor speeds are desired. Since the rotors are driven through a fixed ratio established by the gearbox, belts and drive pulleys, optimum engine power often cannot be obtained during panning without risking excessive rotor speeds.

It is desirable to provide a riding trowel wherein the engine or engines can operate at ideal speeds over a wide range of finishing conditions. One solution pioneered by Allen Engineering Corporation, is the subject of pending U.S. patent application Ser. No. 09/008,355, filed Jan. 16, 1998, and entitled "Riding Trowel with Variable Ratio Transmission." The object is to vary the overall drive gear ratio during different panning and blade finishing stages so that motors may operate within optimum RPM ranges as much as possible. In the Allen design, the effective drive ratio established between the motor output pulleys and the drive pulleys splined to the gearbox input shaft can be dynamically varied. However, since the rotor gearbox reduction ratio is still fixed, the range of adjustment of the overall drive train gear ratio (i.e., the ratio between motor RPM and rotor RPM) is limited. What appears necessary is a variable ratio "drive gear" for revolving the rotors that allows the motors to maintain a relatively constant speed over a variety of working conditions and loads. Hydraulic drive motors provide the potential to solve this problem.

Many early riding trowels use manually operated levers for steering. The steering levers project upwardly from the frame and are grasped and manipulated by the operator to direct the machine. The steering levers deflect linkages below the trowel frame to tilt the rotors. Often a vigorous physical effort is required. Where separate engines are used with each rotor assembly, additional physical effort is required to tilt the rotors for steering, or to vary blade pitch. It has now been established that modern, state-of-the art riding trowels require power steering for maximum performance. Hydraulic steering systems for multiple engine trowels previously proposed by Allen Engineering Corporation have proven desirable. For example, copending Allen Engineering Corporation patent application Ser. No. 08/784,244, filed Jan. 15, 1997, entitled "Hydraulically Controlled Riding Trowel" discloses a powered steering system for riding trowels. Quick, responsive handling optimizes trowel efficiency, and preserves operator safety and comfort.

At the same time, the use of hydraulic propulsion and hydraulic power steering amplifies the requirement for available horsepower. By using hydraulic motors to drive trowel rotors, the internal combustion motors may operate continuously within ideal RPM ranges. The resultant horsepower increase more than offsets losses caused by hydraulic inefficiencies. However, the added weight from large internal combustion engines, hydraulic drive motors, and the required hydraulic accessories affects trowel handling and response.

The heavier and more powerful the trowel, the more important it is to establish responsive steering and fast, effective handling. However, not all trowel operators are equally experienced. Operators who first learned to drive riding trowels on older, manually steered, lever controlled models gradually became used to the lever "feel" and the handling characteristics of such designs. As hydraulic steering systems evolved, it was thought important to maintain a "feel" that was "backward compatible" with the expectations of more skilled operators. Late model riding trowels have replaced heavy, manual steering levers with lightweight, easily deflected joysticks. It has been preferred that the joysticks be deflectable in the same relative directions as older steering levers, so that required operator hand movements on older and newer trowels are substantially similar. Thus, those hand motions and reflexes previously learned by the driver on older trowels will aid the driver in mastering joystick-equipped trowels. However, many younger workers entering the job market have never driven the older, lever-controlled trowels. As the popularity of riding trowels continues to rise, the desirability of backwards compatibility may be fading. At the same time it remains important that trowels be easy to operate and steer. Especially with the advent of modern, high powered, internal combustion engines for trowel use, it appears practicable to control hydraulically powered riding trowels without levers or joysticks.

Through years of experimentation we have found it possible to control a trowel with a steering system comprising drive pedals and a steering wheel. The ideal system handles similarly to those used on automobiles or tractors. Hence we have designed a multiple-rotor, hydraulically driven trowel that can be steered like an automobile or tractor. In the best mode the hydraulic drive system employs foot pedals and a steering wheel for optimizing steering and control.

SUMMARY OF THE INVENTION

Our new riding trowel preferably comprises a generally triangular frame supporting a separate rotor assembly at each of its three vertices. Each rotor assembly is gimbaled to the frame and tilted by double acting, hydraulic pistons. For propulsion, the left and right rear rotor assemblies are tilted in a plane coincident with the biaxial plane established and occupied by their parallel and coplanar axes of rotation. For steering effects, the front rotor assembly is tilted in a plane perpendicular to said biaxial plane. Each rotor assembly is directly driven by a hydraulic motor. One or more internal combustion motors power suitable hydraulic pumps for energizing hydraulic motors and accessories. Since the rotor assemblies are directly driven hydraulically, mechanical gearboxes are avoided. The preferably gasoline or diesel powered internal combustion motor operates over an optimized RPM range.

The driver is comfortably seated adjacent the trowel controls. A rotatable steering wheel positioned in front of the operator substantially controls steering. It activates a suitable valve coupled to downline hydraulic components, and ultimately tilts the front rotor for steering and maneuvering. Suitable foot pedals can be deflected by the toe or heels of both feet to control propulsion by tilting the rear rotors. Complex maneuvers can be executed by heel and toe movements of the foot pedals in combination with steering wheel actuation. One or more internal combustion motors that power the hydraulic drive circuit run at optimum speeds, making ample horsepower readily available. The extra horsepower adequately powers the energy demands of the entire hydraulic system. The increased weight and horsepower of the system demands an improved steering design. Our preferred hydraulic steering system readily delivers the enhanced functional characteristics that make hydraulic drive practicable.

Thus, a fundamental object of our invention is to provide a hydraulically driven and hydraulically steered riding trowel.

A related object is to provide a hydraulically operated riding trowel that drives and steers somewhat like an automobile.

Another fundamental object is to provide a hydraulic, direct drive riding trowel that handles well and feels comfortable to a relatively new driver who may lack experience with lever-steered or joystick-controlled riding trowels. Another fundamental object of our invention is to provide a hydraulic direct drive system adapted for multiple engine riding trowels.

Another important object is to provide power steering and power blade pitch control for use with hydraulic, direct drive riding trowels.

A further object is to accomplish the above mentioned goals without the use of electrical components characterizing electrical-over-hydraulic steering and control systems.

Another object is to simplify the circuitry needed for effective joystick control of powered riding trowels.

A related object is to make it easier to drive high power, triple rotor riding trowels.

Another related object is to reduce the physical effort required to safely drive a triple-rotor riding trowel.

Another basic object is to provide a hydraulic direct drive system and a complimentary hydraulic power steering system for high power riding trowels characterized by multiple rotor assemblies.

It is also an object to successfully combine hydraulic power steering and direct hydraulic drive for high powered riding trowels.

Similarly, it is an object to provide hydraulic steering and hydraulic direct drive systems that are effective over a wide variety of operating conditions.

A further object is to provide a triple-rotor riding trowel characterized by direct hydraulic drive and hydraulic steering that readily handles conventional blades, combo-blades, or finishing pans.

A still further object is to provide a hydraulic propulsion and steering circuit that functions on a variety of riding trowels, including diesel or gasoline powered trowels having one, two or three internal combustion motors.

Another object is to provide a high power riding trowel that overcomes power-draining vacuum effects that occur when panning wet concrete.

Another basic object is to provide a functional, hydraulic drive system for riding trowels that enables directional and variable speed control, while applying relatively constant torque under varying speed conditions.

A still further object is to provide a direct drive hydraulic system of the character described that enables the trowel internal combustion motor to run constantly within an optimum RPM and horsepower range.

Yet another object is to provide a power steering riding trowel wherein the rotors flatten the concrete surface sufficiently to attain the high "F-numbers" (i.e., flatness characteristics) that are established by ACI regulations.

Another object is to provide a multiple-rotor, high power riding trowel that is inherently stable and easy to maneuver.

A related object is to provide multiple-rotor riding trowels that are ideal for pan finishing and quick curing concrete jobs.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and are to be construed in conjunction therewith, and in which like reference numerals have been employed throughout in the various views wherever possible.

DETAILED DESCRIPTION

Figure 1:
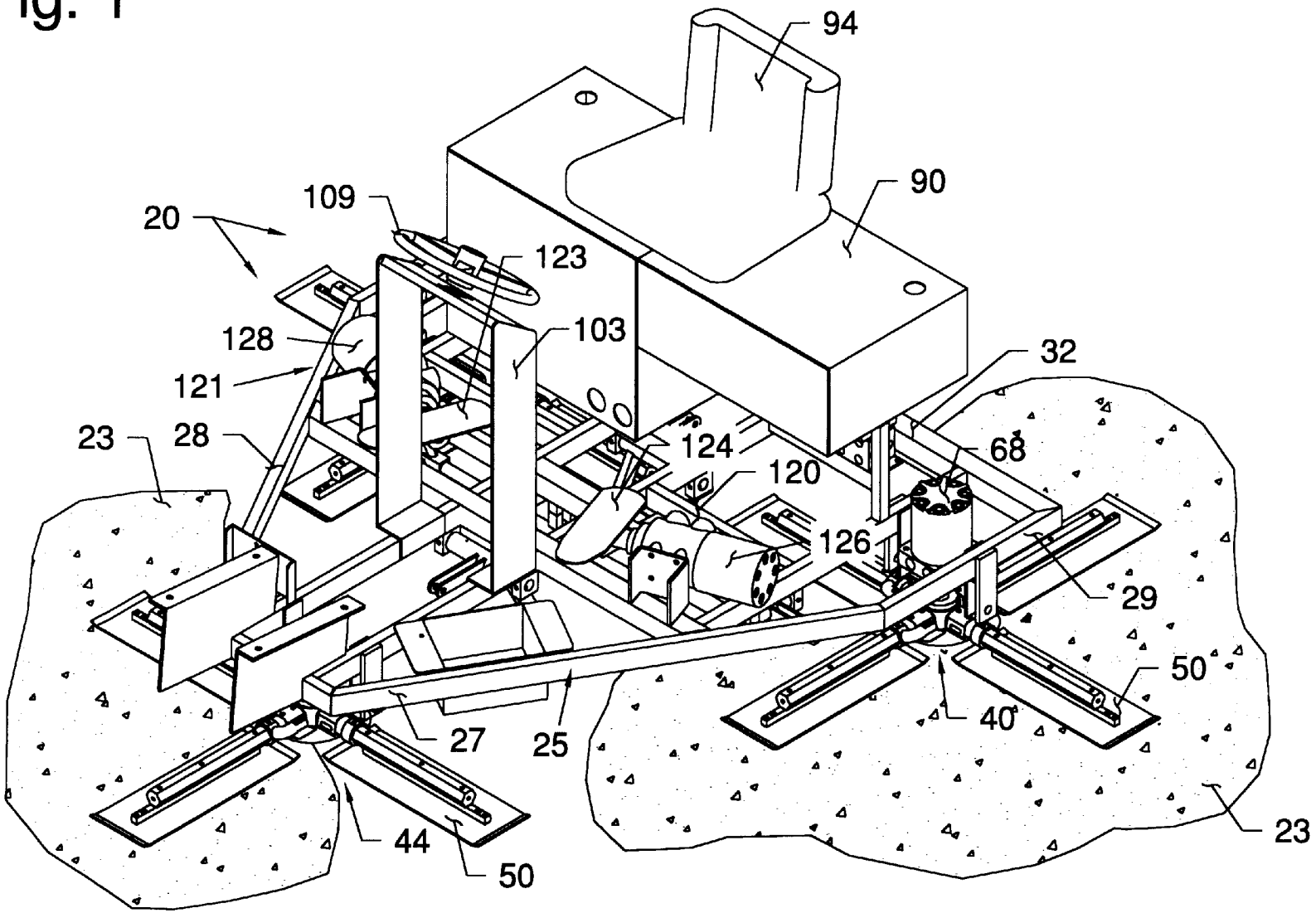
FIG. 1 is a partially fragmentary, front isometric view of our Hydraulically Driven, Multiple Rotor Riding Trowel, with portions thereof omitted or broken away for clarity.
Figure 2:
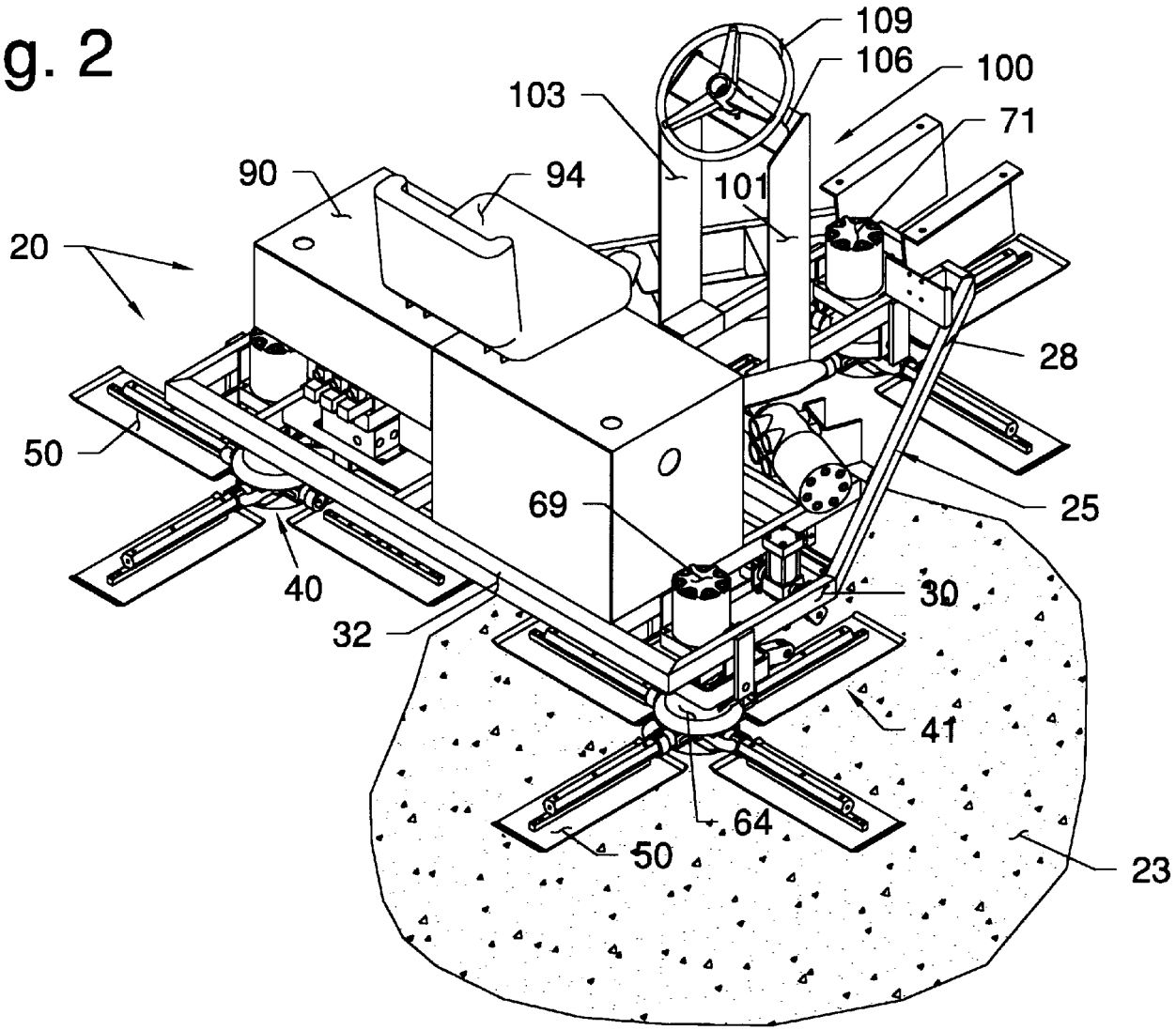
FIG. 2 is a partially fragmentary, rear isometric view thereof.

With initial reference now directed to FIGS. 1–2 of the accompanying drawings, a multiple rotor riding trowel 20 is both hydraulically driven and hydraulically steered. Substantial structural details of pertinent riding trowels are set forth in prior U.S. Pat. Nos. 5,108,220, 5,613,801, 5,480,257, and 5,685,667 which, for disclosure purposes, are hereby incorporated by reference herein. Moreover, many details with respect to the preferred triangular frame and the mounting of various rotors is shown in the parent case hereto, which is also incorporated by reference as if fully set forth herein.

Riding trowel 20 comprises a rigid, generally triangular metal frame 25 formed by forwardly converging sides 27 and 28 (FIG. 1), side panels 29, 30 (FIG. 2), and rear strut 32. The spaced-apart, left and right rear rotor assemblies 40 and 41 respectively are gimbaled to the frame rear. Front rotor assembly 44 is gimbaled at the frame front, largely supported by spaced-apart frame sides 27, 28. Each rotor assembly comprises a bladed rotor projecting downwardly into contact with concrete surface 23. As explained in my prior patents, the rear rotor assemblies preferably tilt in a plane parallel with the biaxial plane established by the axes 45 (FIG. 3) of their rotation. The front rotor assembly preferably tilts in a plane perpendicular to the biaxial plane. In the best mode known to us at this time, the rear rotor assemblies of trowel 20 do not contra-rotate. However, it will be appreciated that the hydraulic steering and drive systems of the present invention may be used with riding trowels, with either normal or contra rotation, and with one or more gasoline, diesel powered, or alternative engines.

Figure 3:
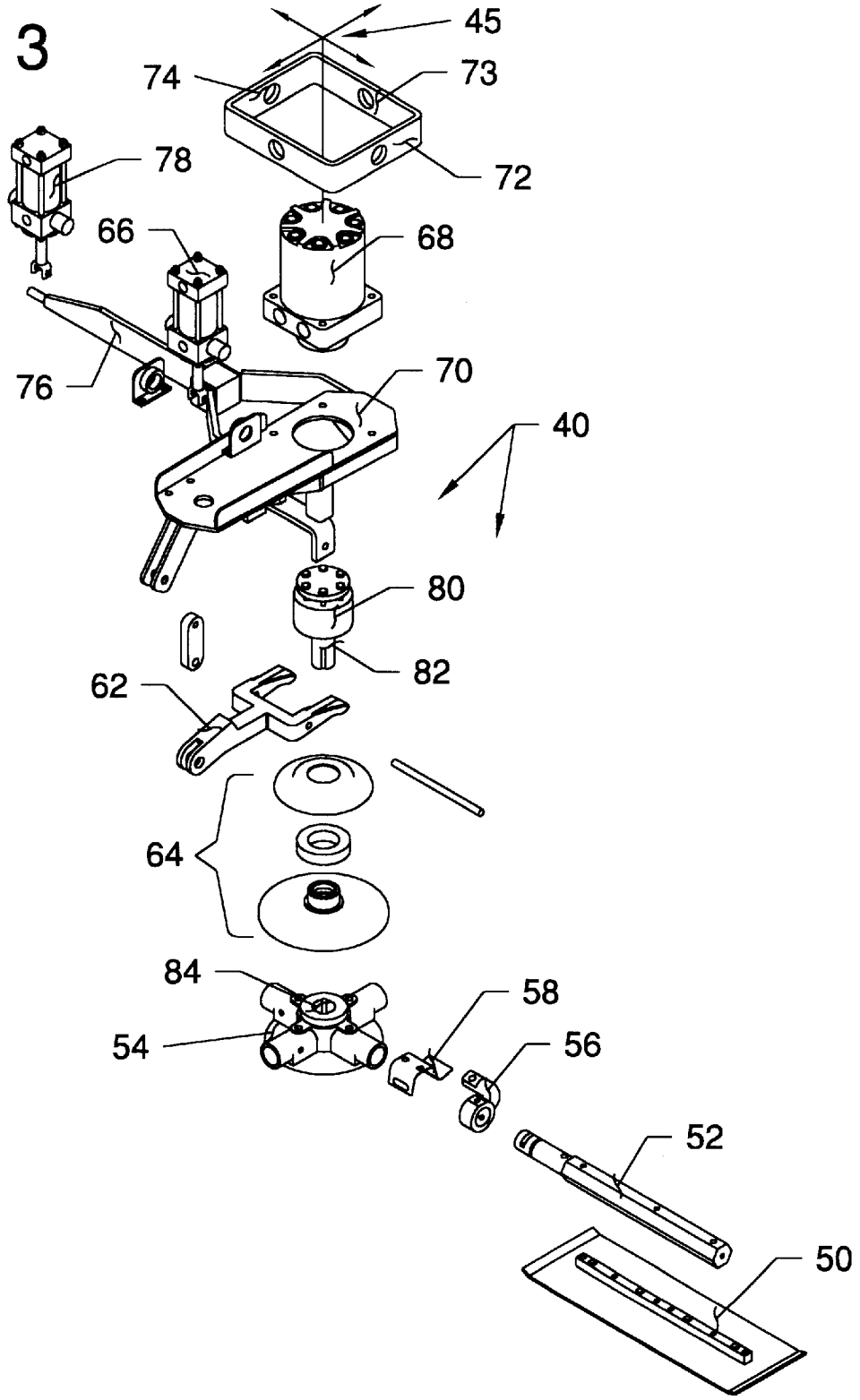
FIG. 3 is an enlarged, exploded isometric view of a typical, gimbaled rotor assembly.

The left rear rotor assembly 40 (FIGS. 1, 3) is substantially similar to each of the others. As explained previously in Allen Engineering Corporation patents referenced above, each rotor assembly comprises a plurality of radially spaced-apart finishing blades 50 that either directly contact the concrete surface 23 or mount suitable finishing pans (not shown). As best seen in FIG. 3, each blade 50 is mounted by a radial arm 52 that is coupled to a spider 54 with torsional deflectors 56 and a spring 58. As explained in prior patents, the fork 62 is deflected against clutch mechanism 64 that presses down against the deflectors 56 associated with each blade to control pitch. Preferably a hydraulic cylinder 66 (FIGS. 3, 8) coupled to fork 62 controls pitch.

Figure 7:
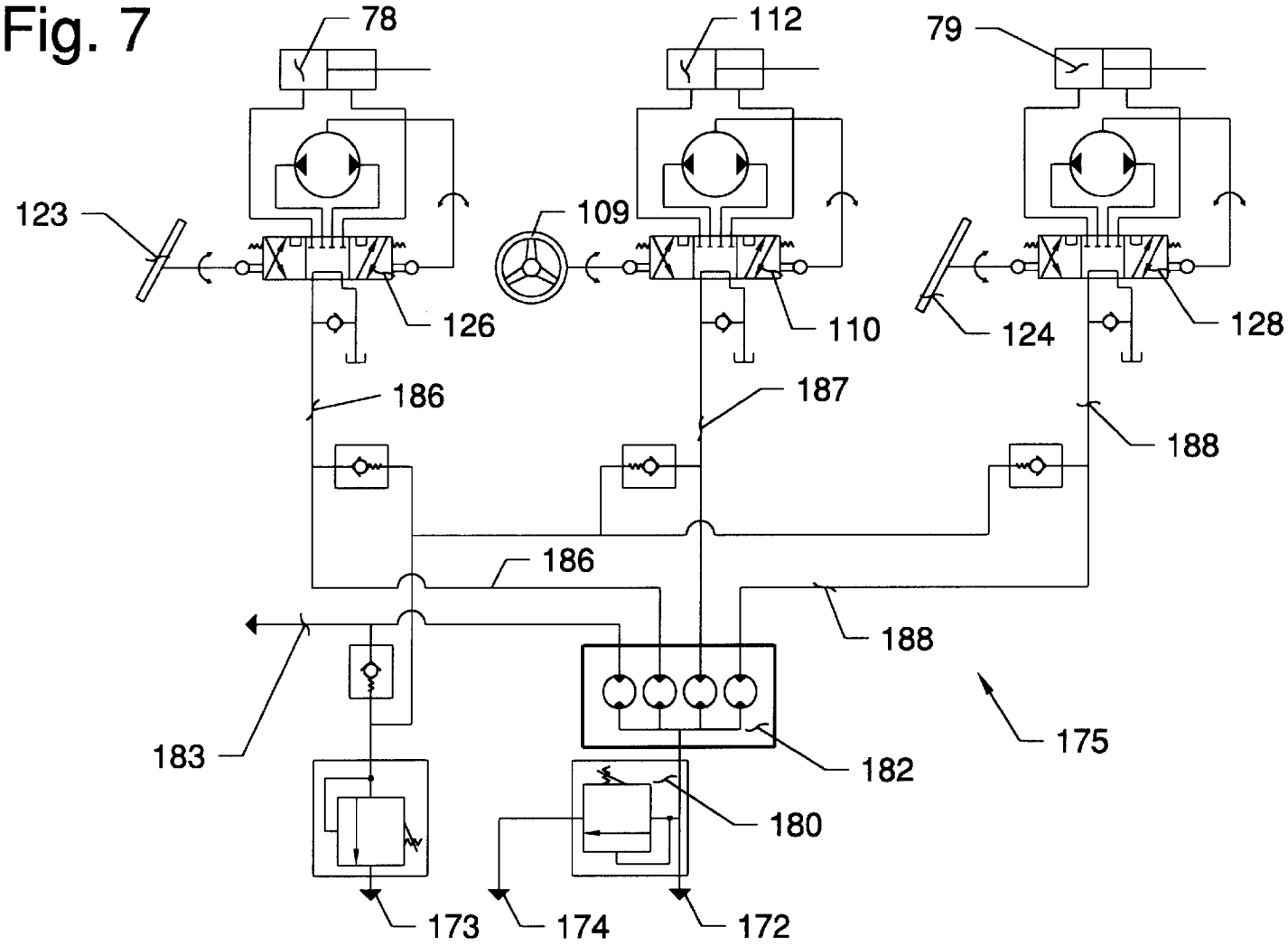
FIG. 7 is a schematic diagram of the preferred hydraulic steering and propulsion control circuit.

The left rear hydraulic drive motor 68 (FIGS. 1, 3) is secured to plate 70 that is preferably gimbaled to the frame 25 by a gimbal box 72. Drive motor 68 (and the other rotor drive motors) preferably comprises a Ross Model ME210203AAAA motor. The tilt direction is established by fasteners penetrating either gimbal orifices 73 or 74; however, rotor assembly 40 tilts in a plane parallel and/or coincident with the biaxial plane in response to tilting by torque arm 76 that is deflected by the left hydraulic tilting cylinder 78 (FIGS. 3, 7). The double action, rotor tilting cylinders 78, 79, and 112 (FIG. 7) are all hydraulically controlled with tilting circuit 175 (FIG. 7) as discussed hereinafter. Motor 68 drives union 80 whose output driveshaft 82 is splined to spider 54 within orifice 84. Thus, as appreciated from FIG. 3, each rotor assembly is rotated by a hydraulic drive motor, and tilted for propulsion or steering by a hydraulic cylinder. Additionally, the pitch of each rotor assembly may be varied by a hydraulic cylinder. The right side rotor assembly 41 is driven by hydraulic motor 69 and the front rotor assembly is driven by hydraulic motor 71 (FIG. 2).

Figure 4:
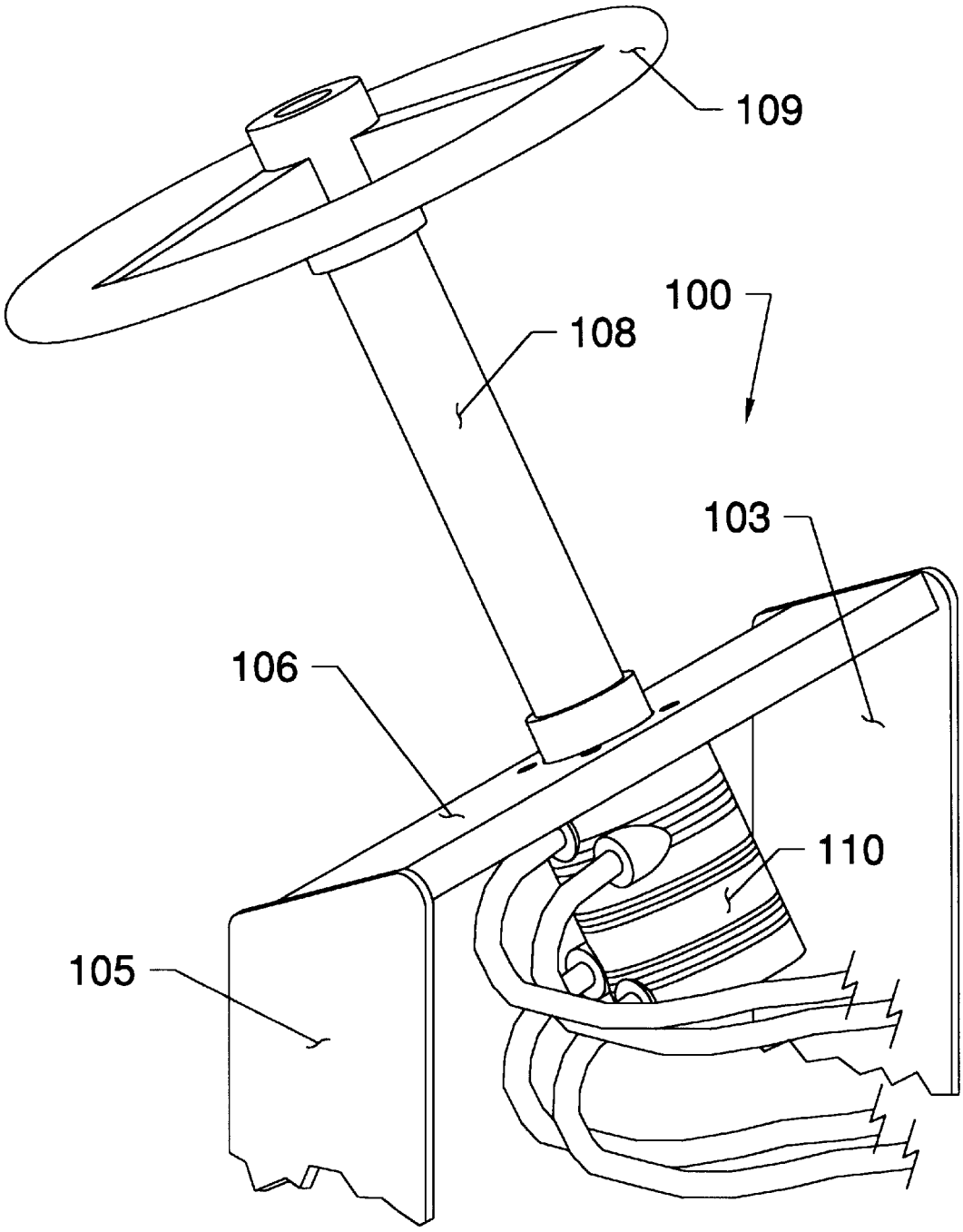
FIG. 4 is an enlarged, fragmentary, isometric view the steering wheel system.

An operator station 90 mounted at the top of the frame 25 shrouds the internal combustion drive motor 92 (FIG. 6) and supports operator seat 94. Seat 94 is comfortably disposed apart from a steering wheel system 100 best seen in FIG. 4. System 100 is supported upon and between a pair of upwardly projecting panels 103 and 105 that support dashboard 106. A steering column 108 projecting through the dashboard 106 mounts steering wheel 109 that may be grasped by the driver. The steering wheel directly controls a proportional hydraulic valve 110 (FIGS. 4, 7), which controls a tilting cylinder 112 (FIG. 7) associated with the front rotor assembly 44 that is primarily responsible for steering. A suitable lever (not shown) is mounted to one of the panels 103 or 105 for controlling a conventional cable (not shown) that leads to the conventional throttle on the internal combustion motor.

Figure 5:
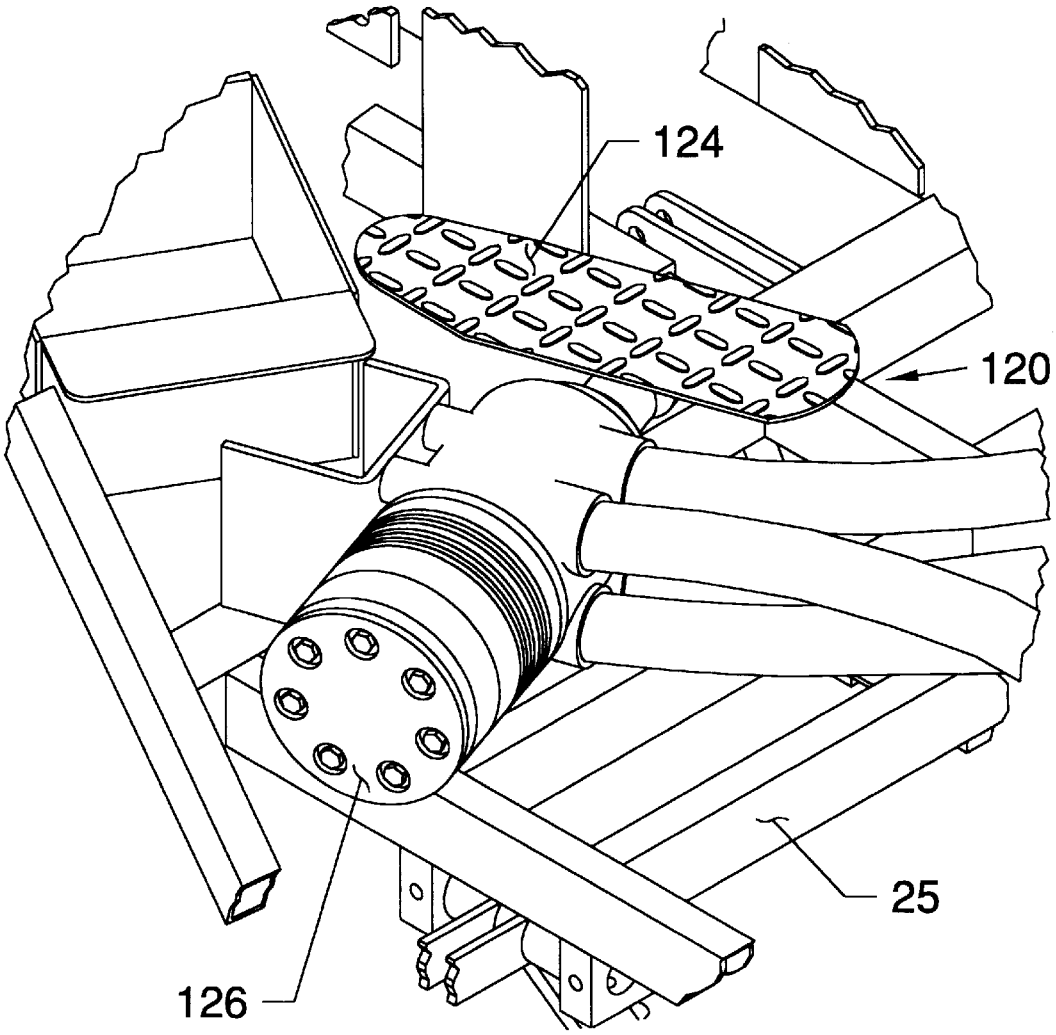
FIG. 5 is an enlarged, fragmentary, isometric view of a preferred foot pedal control.

The left and right rear rotor assemblies are preferably tilted by foot pedal assemblies 120, 121 respectively for propulsion and maneuvering (FIGS. 1, 5). Each foot pedal assembly comprises an operator-accessible pedal 123, 124 (FIG. 1) respectively controlling hydraulic steering control valves 126, 128 (FIGS. 2, 5, 7). The foot pedals function as levers and ultimately tilt the rear rotors for propulsion; they are deflected one way with pressure from the operator's toes or the front of the driver's foot, and deflected the opposite way with suitable pressure from the heel of the foot. As the operator gains skill in driving the trowel 20, a variety of complex motions and maneuvers may be accomplished by combinations of steering wheel rotations and heel-and-toe, foot-pedal motions.

Figure 6:
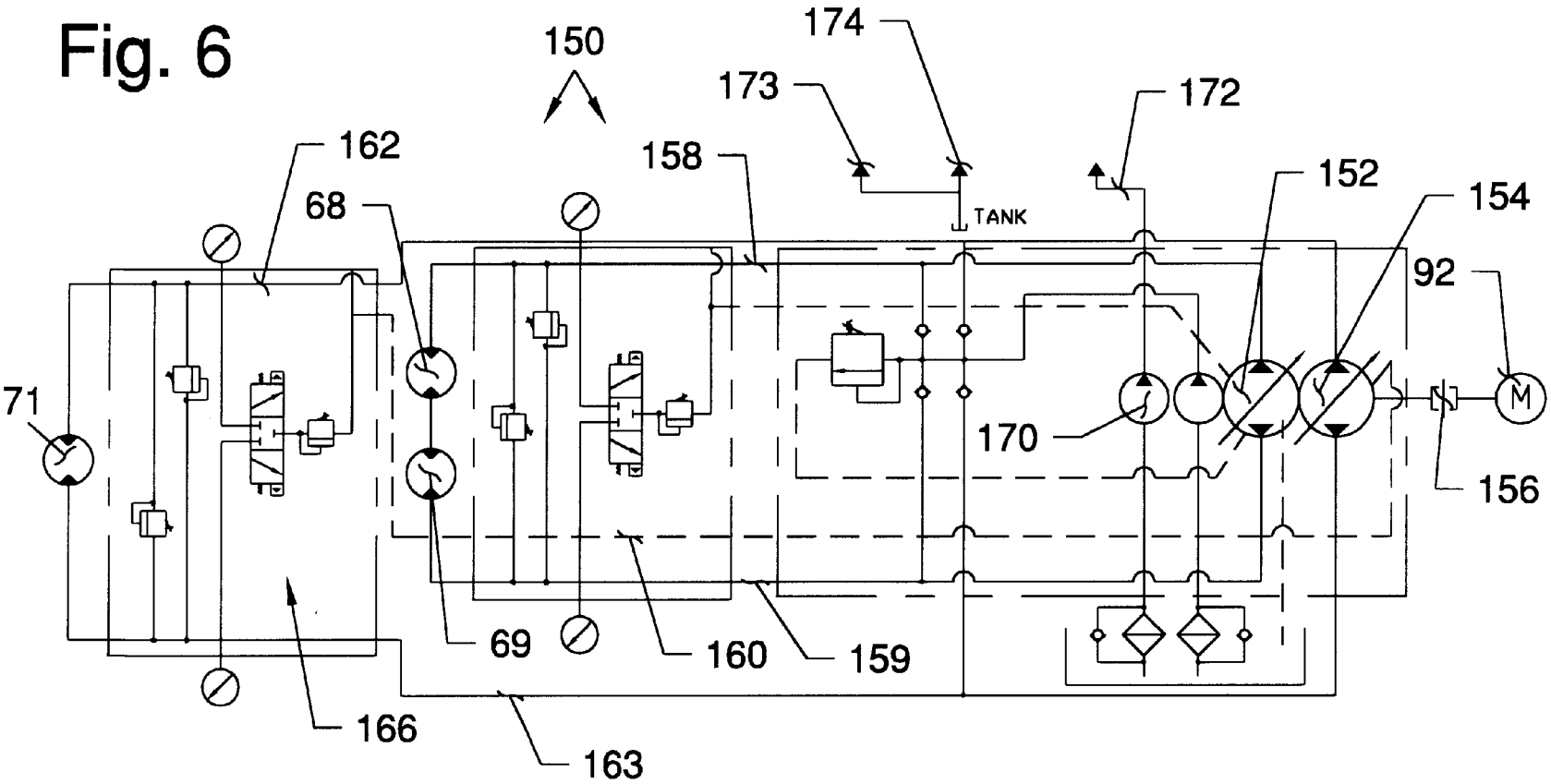
FIG. 6 is a schematic diagram of the preferred hydraulic drive motor circuit.
Figure 8:
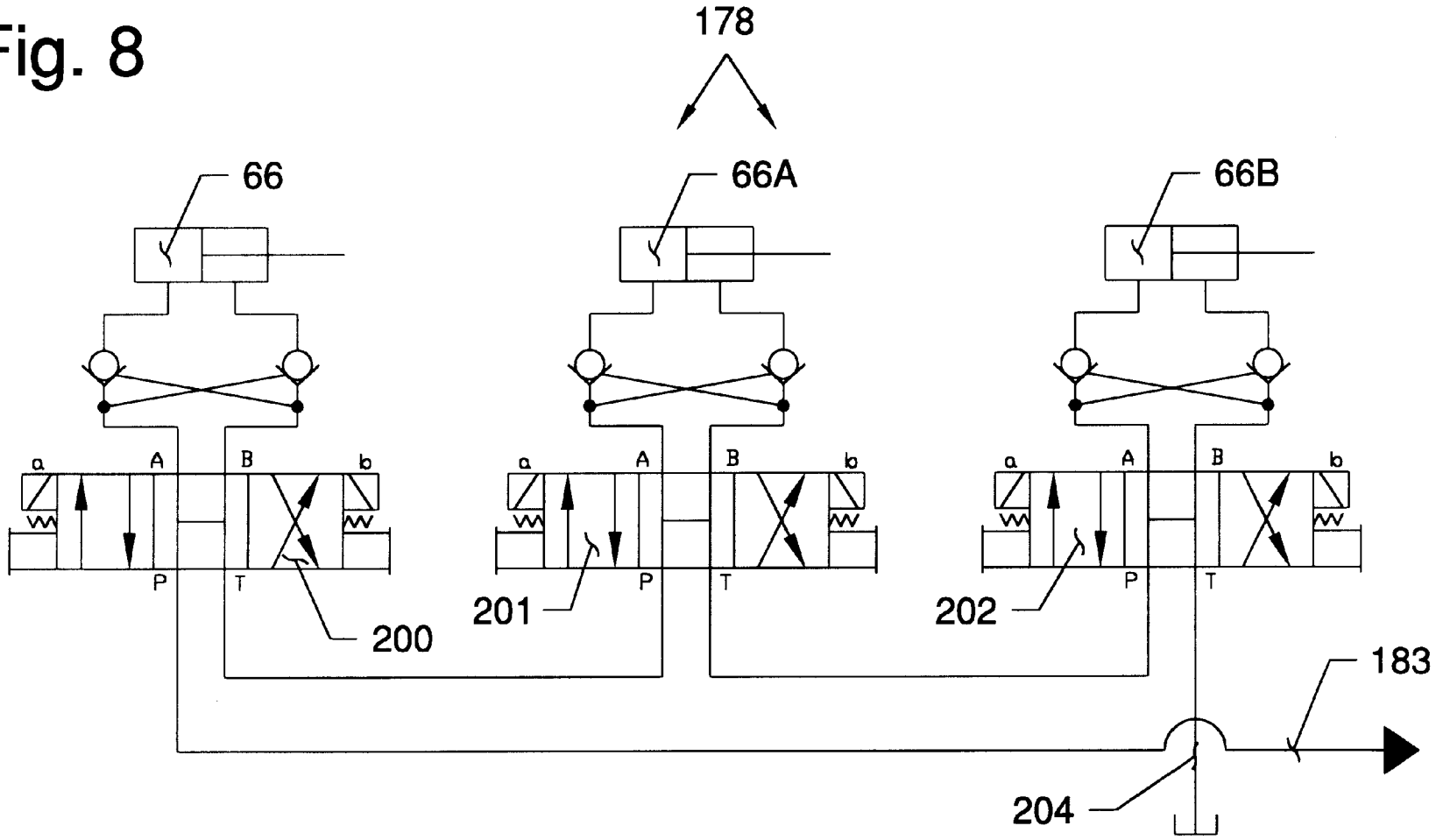
FIG. 8 is a schematic diagram of the preferred hydraulic pitch control circuit; and, FIG. 9 is a pictorial view indicating how to best orient FIGS. 6–8 for viewing.
Figure 9:
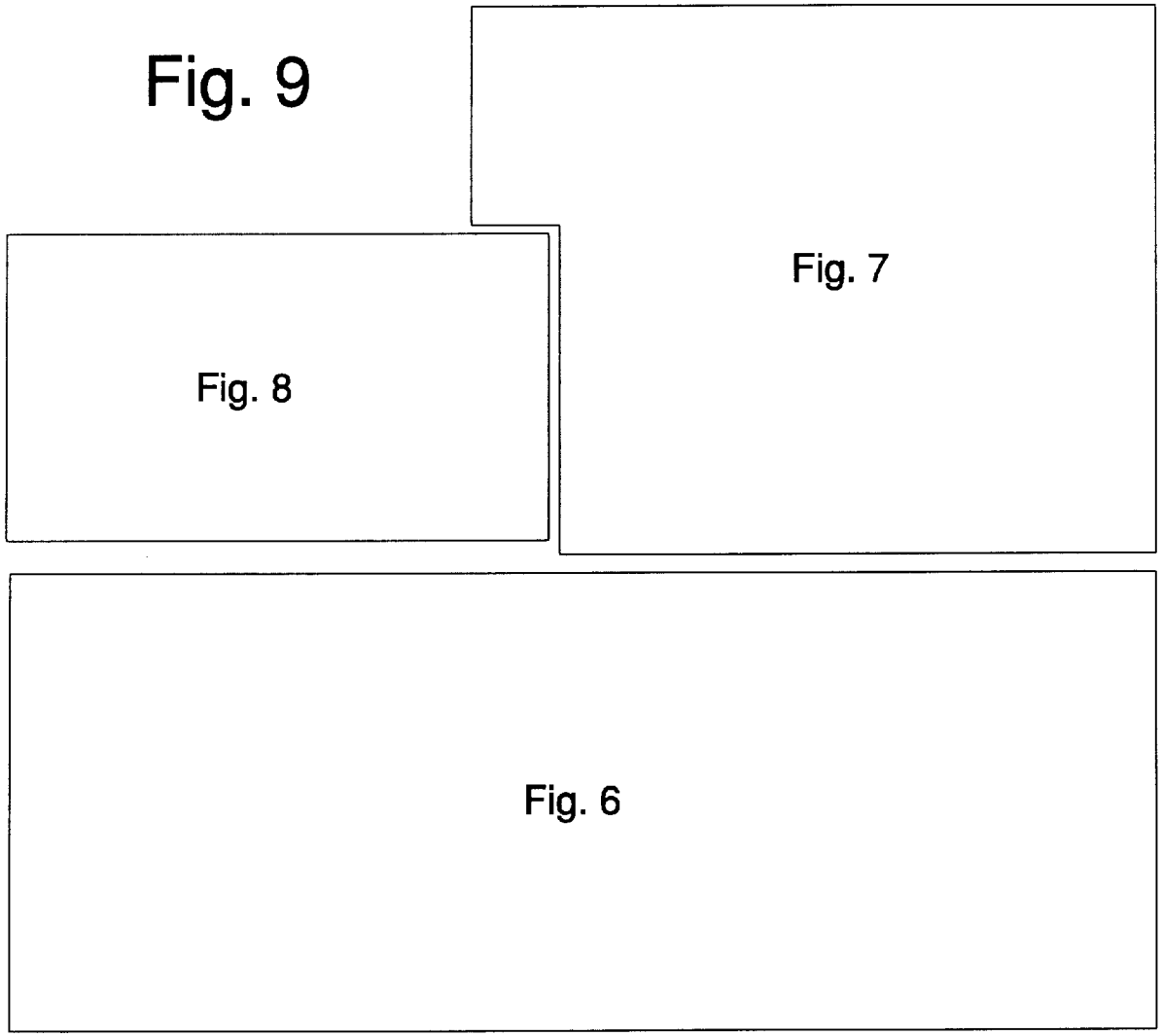

The hydraulic rotor drive circuitry is identified by the reference numeral 150 in FIG. 6 (FIGS. 6–8 should be aligned as in FIG. 9 for convenient viewing). Internal combustion engine 92 drives a pair of hydrostatic, bi-directional piston pumps 152, 154 through coupling 156. Rear rotor drive motors 68, 69 are controlled across lines 158, 159 pressured by pump 152. A cross-over relief package 160 is recommended. Front drive motor 71 is controlled across lines 162 and 163 pressured by pump 154. Another cross-over relief package 166 is provided. Pump 170 pressures lines 172–174 that power the rotor tilting circuit 175 (FIG. 7) and the optional pitch control circuit 178 (FIG. 8).

Turning to FIG. 7, incoming high pressure on line 172 traverses relief valve 180 and enters a four-section, geared flow divider 182. The first output line 183 powers the pitch control circuitry 178 (FIG. 8). The other three outputs 186, 187, 188 respectively control the three hydraulic steering control valves 126, 110, and 128. Suitable valve models are model Hgb40-123 TRW Ross Steering Control Valves. These valves respectively control left tilting cylinder 78, front tilting cylinder 112, and right rear tilting cylinder 79. Cylinders 78, 79 are thus controlled by foot pedals 123, 124 previously discussed. Steering wheel 109 ultimately controls front tilting cylinder 112 through valve 110.

Circuit 178 (FIG. 8) controls the left rear pitch control cylinder 66, front pitch control cylinder 66A, and right rear pitch control cylinder 66B through series-connected reversing valves 200–202 respectively. A return is provided at line 204. Alternatively, conventional cables may be employed for pitch control, as preferred by some trowel operators.

Operation

A variety of operator precautions must be observed for proper operation. The hydraulic tanks should be periodically inspected for proper level, and the rotor blades must be changed as necessary after routine inspections for wear. Fuel tank levels must be sufficient for extended periods of use. During the initial finishing of wet concrete, proper pans will first be installed on the rotors by coupling the rotor blades to the radially spaced-apart brackets provided.

If pressure is applied to the toe portion of pedals 123, 124, the left and right rear rotors will be tilted with the double acting cylinders 78, 79 (FIG. 7), and trowel 20 will move forwardly. Using joint heel action, the machine reverses. In either case the steering wheel 109 influences the direction of travel through front tilting cylinder 112. With the rear rotors untilted (i.e., neutral), subsequent tilting of the front rotor by hydraulic cylinder 112 in response to steering wheel movements will cause the trowel to make gentle, sweeping turns. By a combination of heel and toe actions on alternate pedals 123, 124, vigorous turning maneuvers and crabbing actions can be executed.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A motorized riding trowel for finishing concrete, said riding trowel comprising:

a rigid, generally triangular frame having a front and a rear;

seat means disposed on said frame for supporting a driver;

a pair of spaced-apart, rear rotors gimbaled to said frame rear, wherein the axes of rotation of said rear rotors establish a biaxial plane, and wherein said rear rotors tilt in a plane coincident with or parallel to said biaxial plane;

a front rotor gimbaled to said frame front, wherein the front rotor tilts in a plane perpendicular to said biaxial plane;

wherein the front and rear rotors each comprises a plurality of radially spaced-apart blades for frictionally contacting the concrete surface;

a separate hydraulic motor for powering each rotor;

tilting cylinder means for selectively tilting said rotors for steering and maneuvering the trowel;

internal combustion motor means for powering the trowel;

hydraulic tilting circuit means for controlling said tilting cylinder means;

hydraulic drive circuit means for controlling each hydraulic motor;

hydraulic pump means driven by said internal combustion motor means for powering said hydraulic drive circuit means and said hydraulic tilting circuit means;

driver-operated means for operating said hydraulic tilting circuit means, whereby the driver can steer and control the trowel hydraulically, said driver-operated means for operating said hydraulic tilting circuit means comprises steering wheel means accessible to the driver of said trowel for remotely activating said hydraulic tilting cylinders from a seated position and foot-operated pedal means accessible to the driver of said trowel for remotely activating said hydraulic tilting cylinders from a seated position and, wherein said steering wheel means controls the hydraulic steering control valve associated with said rotor that tilts perpendicularly to said biaxial plane, and said foot-operated pedal means controls the hydraulic steering control valves associated with said rotors that tilt within or parallel to said biaxial plane.

2. A motorized riding trowel for finishing a concrete surface, said riding trowel comprising:

a rigid, generally triangular frame having two rear vertices and a spaced-apart front vertice;

a front rotor assembly and a pair of spaced-apart rear rotor assemblies for powering said riding trowel and frictionally contacting said concrete, the rear rotor assemblies mounted upon adjacent rear vertices and said front rotor assembly mounted adjacent said front vertice, wherein each rotor assembly comprises a plurality of radially spaced-apart blades for frictionally contacting the concrete being finished;

internal combustion motor means supported by said frame for powering said trowel;

hydraulic power steering means for controlling trowel steering and maneuvering, said power steering means comprising:

hydraulic pump means driven by said internal combustion motor means for supplying hydraulic pressure;

a pair of tilting cylinders for tilting the rear rotor assemblies in a plane parallel with a biaxial plane established by the axis of rotation of said rear rotor assemblies, and another tilting cylinder for tilting the front rotor assembly in a plane perpendicular to said biaxial plane, whereby to effectuate trowel steering and maneuvering;

a steering wheel;

at least one foot pedal;

hydraulic circuit means powered by said pump means for proportionally operating the rear tilting cylinders in response to said at least one foot pedal, and for proportionally operating the front tilting cylinders in response to said steering wheel;

hydraulic motor means powered by said internal combustion motor means for revolving each rotor assembly and, said hydraulic circuit means comprising flow divider means for independently pressuring each tilting cylinder.

* * * * *